US008915041B2

(12) United States Patent
Kempf

(10) Patent No.: US 8,915,041 B2
(45) Date of Patent: Dec. 23, 2014

(54) ANGLE SPREADER FOR TRUSSES

(75) Inventor: James Kempf, WallKill, NY (US)

(73) Assignee: Production Resource Group LLC, New Windsor, NY (US)

( * ) Notice: Subject to any disclaimer, the term of this patent is extended or adjusted under 35 U.S.C. 154(b) by 0 days.

(21) Appl. No.: 13/459,335

(22) Filed: Apr. 30, 2012

(65) Prior Publication Data

US 2012/0297718 A1 Nov. 29, 2012

Related U.S. Application Data

(60) Provisional application No. 61/481,158, filed on Apr. 30, 2011.

(51) Int. Cl.

| | |
|---|---|
| ***E04H 12/18*** | (2006.01) |
| ***E04B 1/38*** | (2006.01) |
| ***E04B 1/19*** | (2006.01) |

(52) U.S. Cl.

CPC .... *E04B 1/19* (2013.01); *E04B 1/38* (2013.01)
USPC ..... 52/645

(58) Field of Classification Search

CPC ..... E04H 12/187; E04B 1/19; E04B 1/1903; E04B 1/215; E04B 1/24; E04B 1/344; E04B 1/2403; E04B 1/2608; E04B 2001/2415; E04B 2001/2496; E04B 2001/2457; E04B 2001/2684; E04B 2001/405; E04B 2001/2439; E04B 2001/2616; F16B 7/044; F16B 7/0453; F16B 7/025; F16B 7/02; F16B 7/06; F16B 7/063; F16B 7/107; F16B 7/045; F16B 1/2604; F16B 1/2612; F16B 1/40; F16B 9/20; E04C 5/168; E04C 5/18; E04C 2003/026; E04C 2003/0486; E04C 2003/2448
USPC ..... 52/641, 645, 655.1, 693, 696, 712, 713
See application file for complete search history.

(56) References Cited

U.S. PATENT DOCUMENTS

| | | | | |
|---|---|---|---|---|
| 3,423,898 | A * | 1/1969 | Coloney et al. | 52/713 |
| 5,094,059 | A * | 3/1992 | Ganescu | 52/641 |
| 5,553,961 | A * | 9/1996 | Olden | 403/119 |
| 7,918,054 | B2 * | 4/2011 | Grafton et al. | 52/92.3 |
| 2010/0077694 | A1 * | 4/2010 | Quintile et al. | 52/712 |
| 2010/0269445 | A1 * | 10/2010 | Gannon et al. | 52/645 |
| 2011/0142591 | A1 * | 6/2011 | Kempf et al. | 414/815 |

* cited by examiner

*Primary Examiner* — Jessica Laux
(74) *Attorney, Agent, or Firm* — Law Office of Scott C. Harris, Inc.

(57) ABSTRACT

A truss hinge that allows hinging between truss parts, and also allows configuration into a different size, and spreads the angle of the truss open ends. One embodiment uses a first plate, having a connection part to a first truss, where the connection part is adapted for connection to a first truss. A second plate is movable relative to the first plate. The second plate also has a second connection part adapted for connection to a second truss. An angle setting part forms a connection between the first plate and the second plate, that holds the first plate relative to the second plate at any of a number of different relative locations between the first plate and the second plate. The plates include angle markings to set the connections.

7 Claims, 6 Drawing Sheets

ANGLE SPREADER FOR TRUSSES

This application claims priority from Provisional application No. 61/481,158; filed Apr. 30, 2011, the entire contents of which are herewith incorporated by reference.

BACKGROUND

Trusses are often used in stage lighting applications to hold stage lights and other items as supports relative to the stage, e.g., above the stage level as supported from a supporting beam above a stage or other object of lighting. Two pieces of truss may be connected together to form longer overall trusses.

A truss hinge is described in our copending application Ser. No. 13/098,410, filed Apr. 30, 2011, the entire contents of which are herewith incorporated by reference.

SUMMARY

An embodiment describes a truss end support that supports between open ends of trusses.

DETAILED DESCRIPTION

The structure of an embodiment is shown in FIGS. 1-8. This describes a hinge spreader, which can hold between the open ends of the hinged trusses. These adjustable truss end supports adjust to multiple lengths. In one embodiment, these can be used to form and support any angle between two connected truss parts. In another embodiment, these can form 4, 5, 6, 7 or 8 sided truss rings or arcs with 45, 51.4, 60, 72, 90 degree angles.

Figure 1:
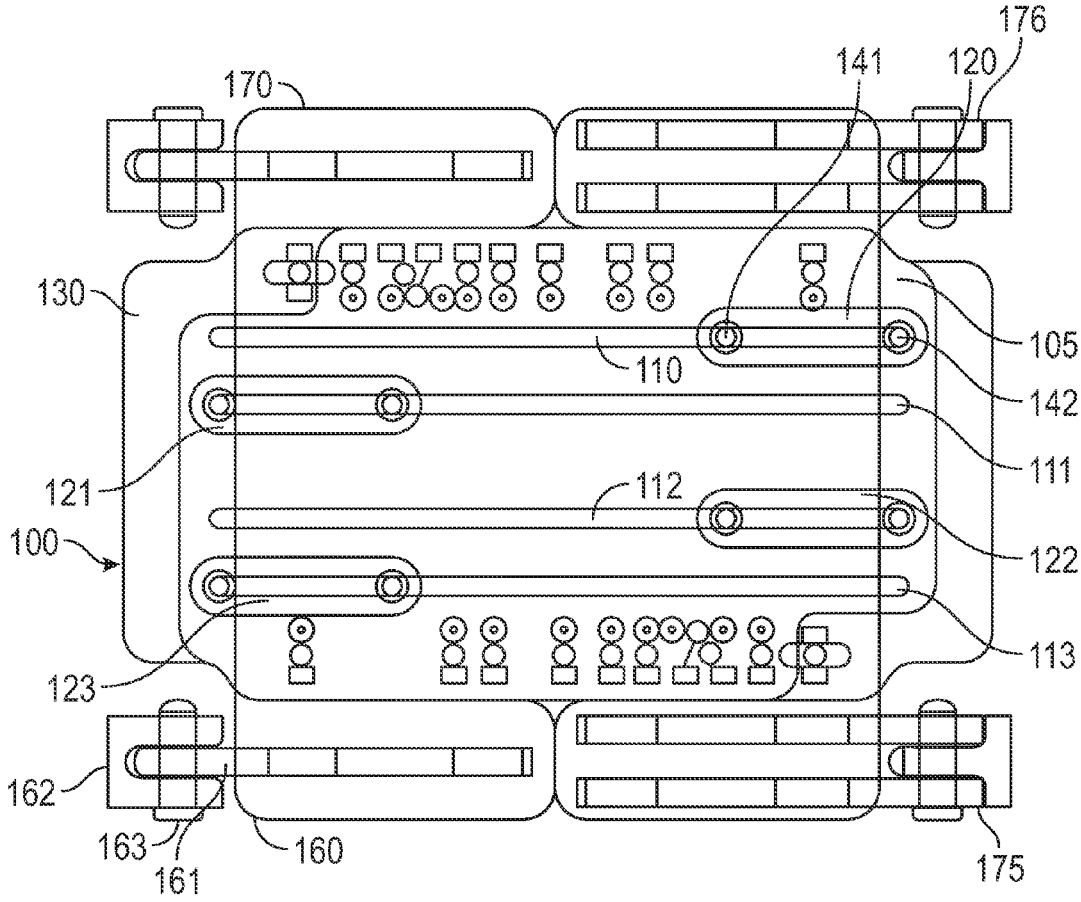
FIG. 1 shows an adjustable truss end support in a front view.

The adjustable truss end support 100 is formed of plates 105, 130 which overlap has a number of different attachable slots therein. FIG. 1 shows a front view of the adjustable truss end support, showing the two overlapping plates 105, 130, each with first, second, third and fourth elongated slots therein shown respectively shown as 110, 111, 112 and 113. Each of the slots includes a locking plate such as 120 which is located in the slot 110 and holds the plates 105, 130 to one another at the desired spacing. The locking plate 120 is held between the slot 110 of the front spreader plate 105, and the corresponding slot of the rear spreader plate 130.

In a similar way, there is a locking plate 121 that is located in the slot 111. Locking plate 121 is at the opposite end of the slot from the side housing the plate 120 and also is facing in an opposite direction from locking plate 120 (seen in FIG. 2). In a similar way, slot 112 includes locking plate 122 and slot 113 includes locking plate 123. Each two adjacent locking plates are at opposite ends of the plates 105, 130 and opposite surfaces of the plates 105, 130; such that each locking plate is at an opposite end from the immediately adjacent locking plate. Each of the locking plates connect via two screws, for example the locking plate 120 includes a first screw 141 and a second screw 142.

Figure 2:
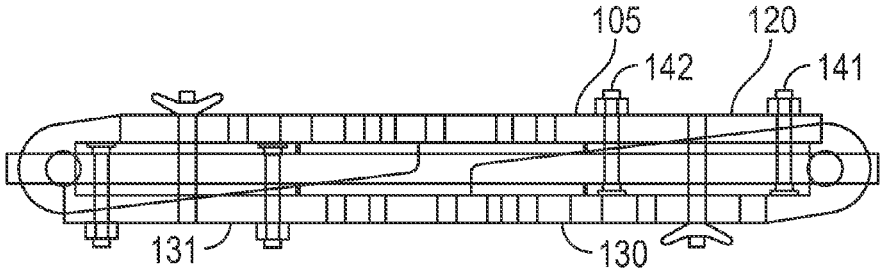
FIG. 2 shows the same device in a plan view.

FIG. 2 shows a plan view, showing how these locking plates are connected at opposite ends. As clearly seen in FIG. 2, locking plate 120 is also at the opposite side and screwed into the opposite spreader plate. That is, while the locking plate 120 may be screwed in from the front side of the spreader plate (the side with plate 105), the locking plate 121 is screwed in from the opposite rear side of the spreader plate (the side with plate 130).

Figure 3:
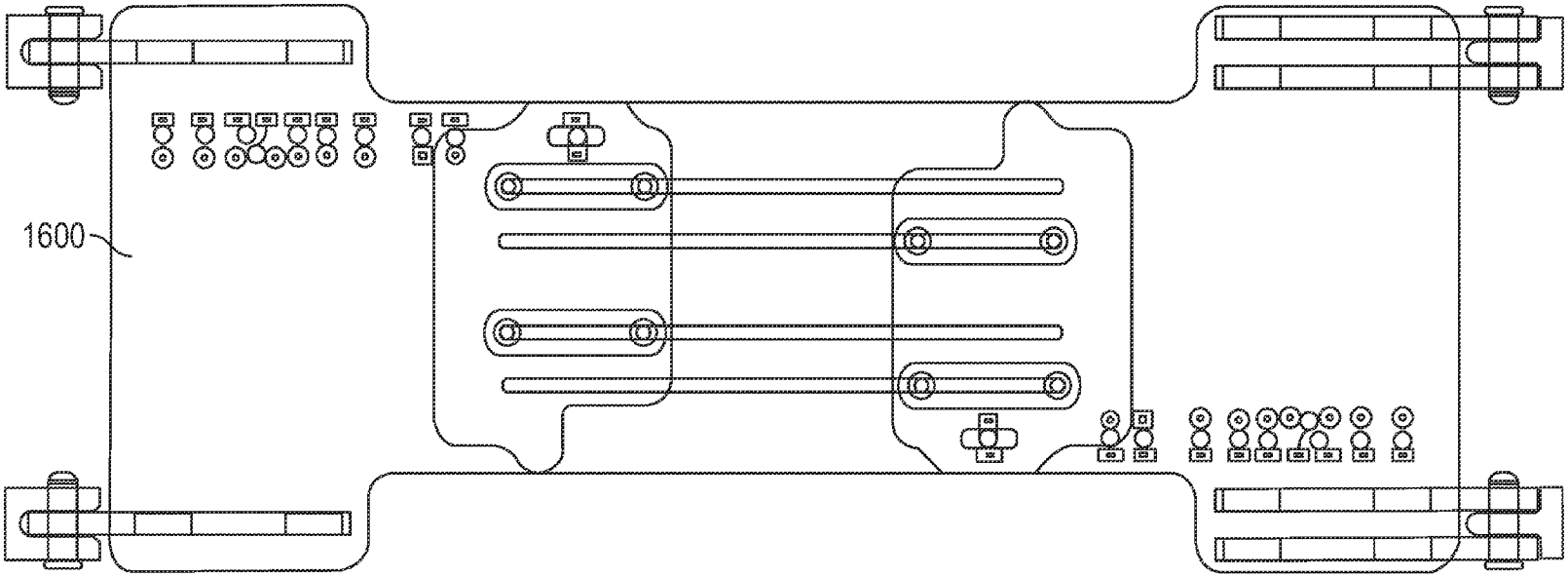
FIGS. 3 and 4 show the device and its fully extended configuration.

In operation, each of the screws such as 142 can be tightened or loosened. When loosened, the distance of overlap of the plates 105 130 can be adjusted. This causes the amount of extension of the plates to be adjusted. FIG. 1 shows the plates with a minimum or close to minimum distance between them. FIG. 3 shows the plates with a maximum distance between them.

In embodiment, each of the plates is attached to a truss. The plate 105 has truss attachment parts 160, 170 at both the top and bottom of the plate. The first part 160 attaches to a first end of a dual pipe truss. For example, the truss end 162 is shown, attached to a mating connection 161 that extends from truss connection part 160. A Cotter pin or screw 163 can hold the truss end 162 to the connection 161.

In a similar way, the plate 130 includes a first truss connection part 175 and a second truss connection part 176, which can connect to second truss that is going to be held relative to the first truss attached to the first plate 105.

Therefore, the hinge spreader holds the distance between truss edges. The hinge spreader is adjustable to allow different amounts of space between the stress edges, thereby changing the angles between the trusses as explained herein.

Figure 4:
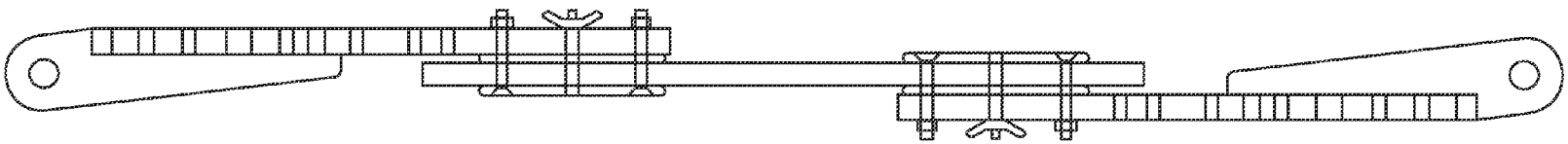

FIG. 3 shows the assembly in its maximized position, that is with the maximum distance between truss ends. FIG. 4 shows a plan view of the same device.

Figure 5:
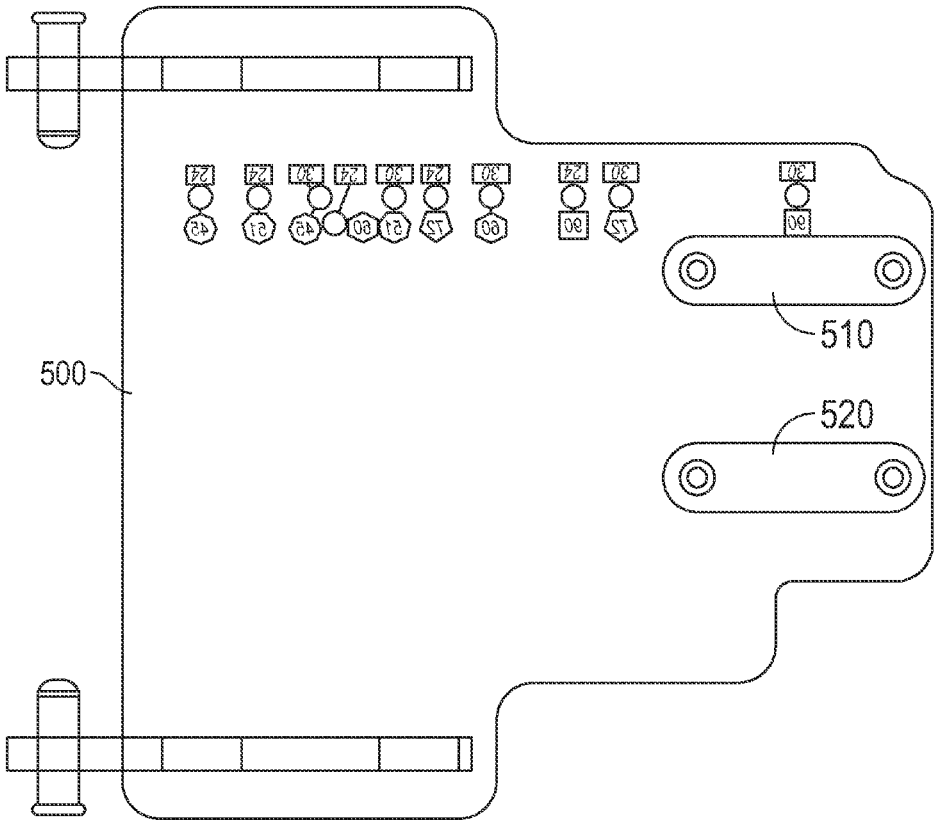
FIGS. 5 and 6 show first side plates of the device.
Figure 6:
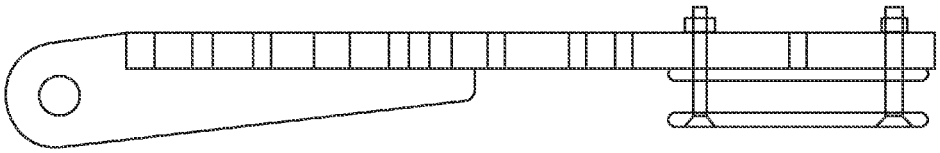
Figure 7:
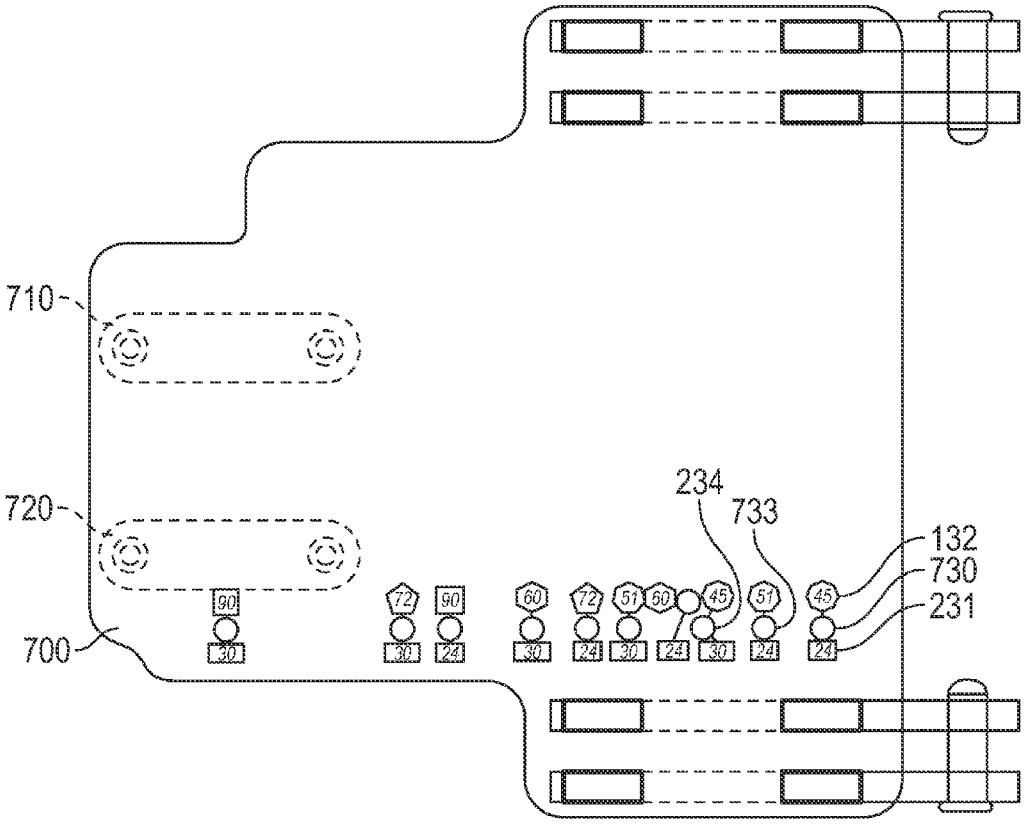
FIGS. 7 and 8 show second side plates of the device.
Figure 8:
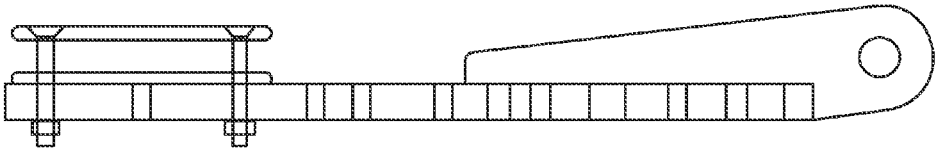

The parts which form the hinge spreader are as shown in FIGS. 5-8, with the left side plate 500 shown in FIG. 5, having two locking plates 510, 520 thereon. FIG. 5 also shows details of the connection to the truss part. The right side plate shown in FIG. 7 as 700 also has two locking plates 710 and 720 attached thereto. FIGS. 6 and 8 show the plan views of the FIGS. 5 and 7 plates.

Figure 9A:
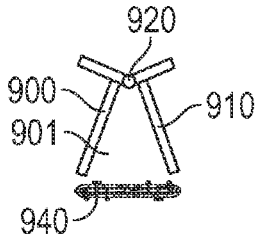
FIGS. 9A-13C show different configurations using the adjustable truss end support.

FIG. 9A-13C show the different configurations in which the device can be configured. FIGS. 9A, 9B and 9C show the different configurations of the device when maintained in the 45° configuration. In this configuration, truss piece 900 is connected and hinged to truss piece 910 at hinging part 920, which can be the hinge in FIG. 1. The adjustable truss end support 940 is shown between the opposite ends of the hinged truss, configured to a close to minimum length. In FIG. 9A, this is shown for 9 inch trusses, and hence maintaining a 45° angle 901 between the truss pieces 900, 910, which requires that the adjustable truss end support be configured to 1.838 inches.

Figure 9B:
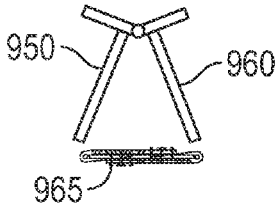

A 30 inch truss is shown in FIG. 9B, where the different parts include 950 and 960 with the adjustable truss end support 940 configured into 6.430 inch length.

Figure 9C:
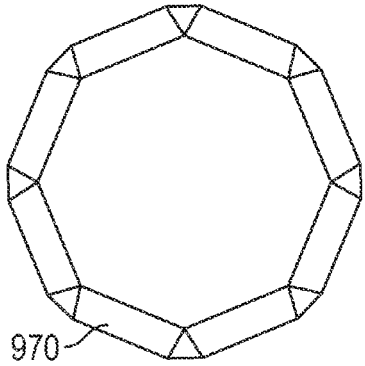

FIGS. 9A and 9B allows configuring the trusses into an octagonal ring configuration 970 as shown in FIG. 9C.

Figure 10A:
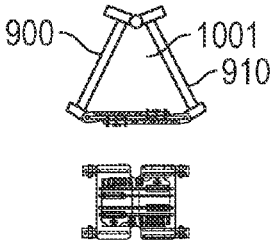
Figure 10B:
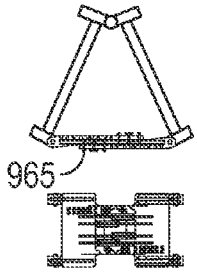
Figure 10C:
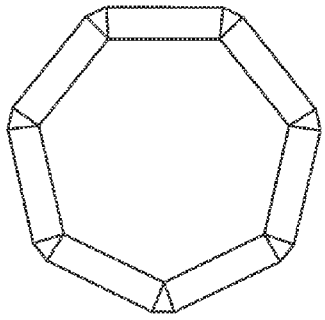

In a similar way, FIGS. 10A, 10B and 10C illustrate how the trusses can be configured into a septagon with a 51.4° angle 1001 existing between the 9 inch truss pieces 920 910 in FIG. 10A, by using the adjustable truss end support set to 19.081 inches. For the 30 inch truss in FIG. 10B, the adjustable truss end support is set to 9.285 inches, to achieve a 51.4° angle necessary for the septagon.

Figure 11A:
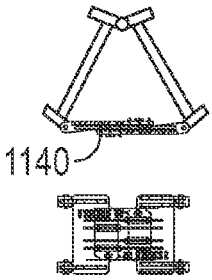
Figure 11B:
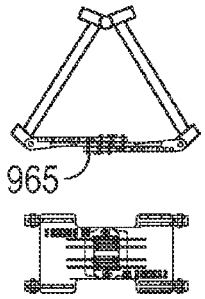
Figure 11C:
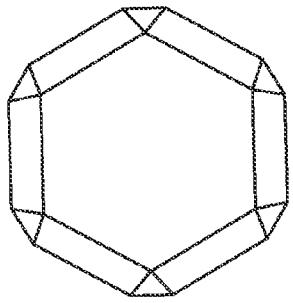

In a similar way, any equilateral structure can be formed. FIGS. 11A, 11B and 11C show the structure for a hexagon, using a 60° angle, with a 7 inch setting on the spreader 940, or a 28 inch setting on the spreader 965.

Figure 12A:
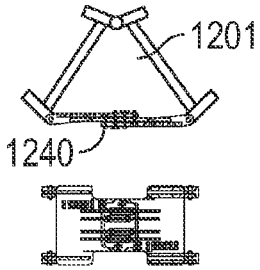
Figure 12B:
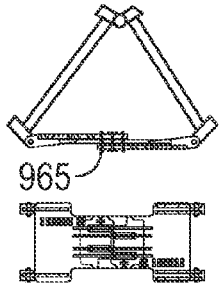
Figure 12C:
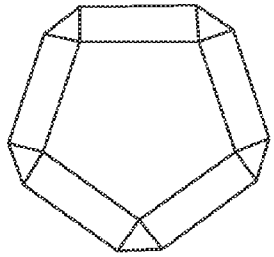

FIGS. 12A, 12B and 12B show the structure for a pentagon, with a 72° angle 1201 set by the spreader 940 being 10.863 inches or the spreader 965 being 32.91 inches.

Figure 13A:
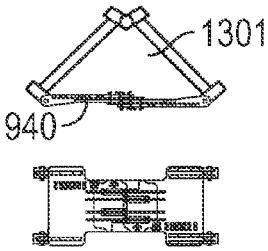
Figure 13B:
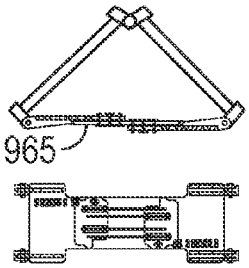
Figure 13C:
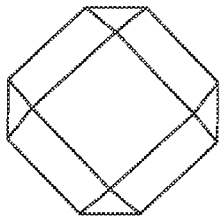

FIGS. 13A, 13B and 13C show a square or diamond configuration, with a 90° angle 1301, and the spreader 940 being 31.13 inches, or the spreader 965 being 39.598 inches.

In one embodiment, in order to facilitate forming the different angles between the hinges, the plates 500, 700 have distance markings etched thereon. For example, FIG. 7 shows the left side plate 700, which has a number of those distance markings. The hole 730 may be associated with multiple distance markings for different kinds of trusses. Distance marking 731 shows that for a 24 inch truss shown as 731, that this will form 45° angles and can be used, therefore, to form an octagon shown as 732. Other distance markings may also be used, for example, distance marking 733 shows a 51° angle for a 24 inch truss, and distance marking 734 shows a 45° angle for a 30 inch truss. Corresponding distance markings are also shown in FIG. 5, to allow configuring the two devices. In FIG. 5, these may be shown in mirror imaged form relative to the markings shown in FIG. 7.

While the above describes non-equilateral or any describes equilateral formations of the trusses, non-equilateral formations can also be made. Also, other sizes and types of truss connections can be made. For example, this device might connect only to one side of each truss, thus having only one truss connection on each side.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example other shapes besides the ones shown in FIGS. 9A-13C can be formed.

Also, the inventors intend that only those claims which use the words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A device for adjusting angles between multiple trusses of a dual pipe truss that has two parallel cylindrical pipes, said device comprising:

a first plate, having a connection part to a first truss, said connection part of said first plate connecting to both of first and second cylindrical and parallel pipes of the first truss, said first plate including a first slot extending along a length of the first plate;

a second plate, movable relative to said first plate, said second plate also having a second connection part connecting to first and second cylindrical and parallel pipes of a second truss, said second plate including a second slot, extending along the length of the second plate;

a hinging part that hinges said second plate relative to the first plate in a way that allows the second plate to move relative to the first plate while the first and second plates are each connected to said first and second pipes of said respective trusses and holds said first and second plates relative to one another, said hinging part including a locking plate that extends and holds between said first slot of said first plate and said second slot of said second plate, where said locking plate is loosened to allow said hinging part to hinge between said first plate and said second plate, and is tightened to hold said first plate to said second plate, said locking plate forming an angle setting part that holds said first plate relative to said second plate at any of a number of different relative locations between said first plate and said second plate;

where each of said first plate and said second plate include angle markings thereon as text which indicates an numerical indication of an angle which will be formed between trusses that are connected to said first plate and said second plate when said locking plate is located adjacent said angle markings.

2. The device as in claim 1, wherein said connections include holes with said angle markings adjacent said holes, and said angle markings include two different text markings showing different values for each of a plurality of said holes, including a first text value for a first size truss, and a second text value for a second size truss for the same said hole, when said first plate and said second plate are maintained at said locations.

3. A device as in claim 1, wherein said locking plate has a first connection being on a first side of the first plate and at a first end of the first plate, and has a second connection being on a second side of the first plate opposite to said first side, and at a second end of the first plate opposite to said first end.

4. The device as in claim 1, wherein locking plate includes two spaced screw connections, which hold along two different locations of at least one of said elongated slots which are loosened to allow said first and second plates to move relative to one another and are tightened to hold said first and second plates against moving relative to one another.

5. The device as in claim 1, wherein said angle setting part includes locations for angles that will create a four-sided configuration, second angles that will create a five sided configuration, third angles that will create a six sided configuration, fourth angles that will create a seven sided configuration, and fifth angles that will create an eight sided configuration.

6. The device as in claim 1, wherein said markings include first markings for a first size truss including a first angle that will be created using said first size truss, and second markings for a second size truss including a second angle that will be created using said second size truss.

7. The device as in claim 1, wherein said angle markings include text markings of numbers that are etched on a surface of the plate.

* * * * *